United States Patent [19]

Thoma

[11] Patent Number: 4,796,818

[45] Date of Patent: Jan. 10, 1989

[54] CHIP SLICER IMPROVEMENT

[75] Inventor: Ed Thoma, W. Vancouver, Canada

[73] Assignee: Beloit Corporation, Beloit, Wis.

[21] Appl. No.: 79,841

[22] Filed: Jul. 30, 1987

[51] Int. Cl.[4] ..... B02C 18/14

[52] U.S. Cl. ..... 241/85; 144/163; 144/176; 241/86; 241/227

[58] Field of Search ..... 144/162 R, 163, 172, 144/174, 176; 241/28, 85, 86, 92, 227, 228, 229, 294

[56] References Cited

U.S. PATENT DOCUMENTS

| | | | |
|---|---|---|---|
| 2,637,359 | 5/1953 | Taylor | 241/85 |
| 2,874,909 | 2/1959 | Pallmann | 241/93 |
| 3,866,843 | 2/1975 | Lunn | 144/176 |
| 3,913,643 | 10/1975 | Lambert | 144/172 |
| 4,235,382 | 11/1980 | Smith | 241/85 |
| 4,583,574 | 4/1986 | Pallmann | 144/172 |
| 4,604,925 | 8/1986 | Wisdom | 144/162 R |

*Primary Examiner*—W. Donald Bray

*Attorney, Agent, or Firm*—Dirk J. Veneman; Raymond W. Campbell

[57] ABSTRACT

A method and mechanism for slicing oversize wood chips including a housing, a cylindrical drum rotatable within the housing, an anvil rotor rotatable within the drum and having a plurality of arms with a blade mounted on each of the arms to move chips along the inner surface of the wall of the drum, said drums having slots therein with knives adjacent the slot so that chips are cut as they are moved along the wall past a slot, and the knives and blades at a relative angle to each other with either one or both of them being at an angle to the axis of the drum and rotating the drum within its housing and rotating the anvil rotor at a slower speed so that the chips are pushed against the inner wall of the drum by centrifugal force and are cut by the scissor action between the blade and knife.

12 Claims, 2 Drawing Sheets

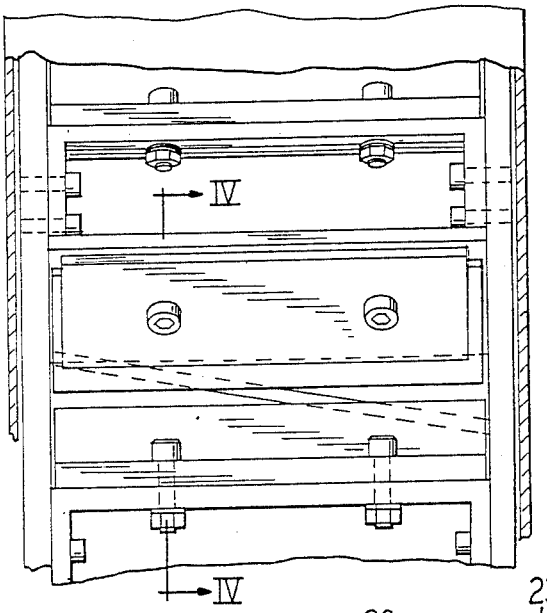
FIG. 3
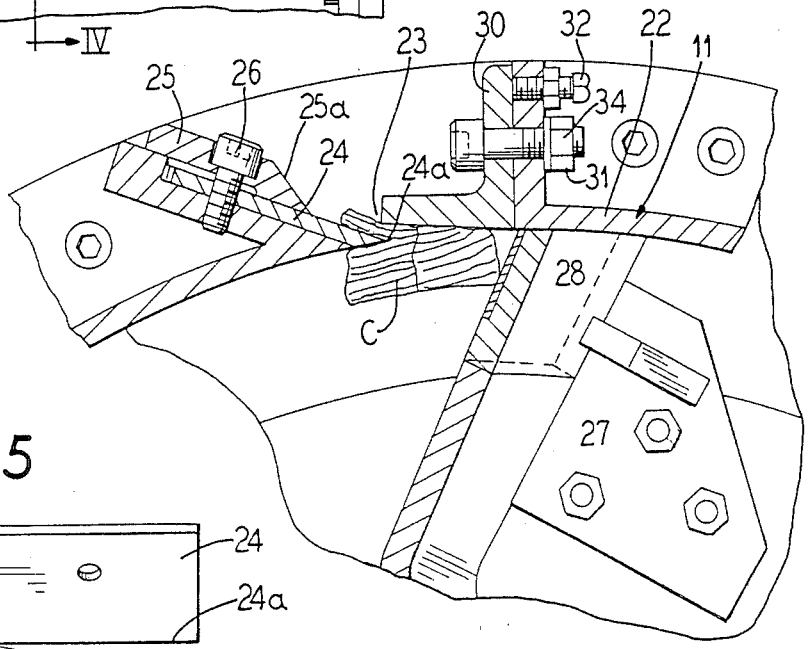
FIG. 4
FIG. 5
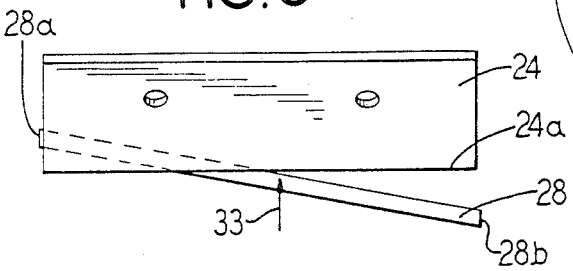
FIG. 7
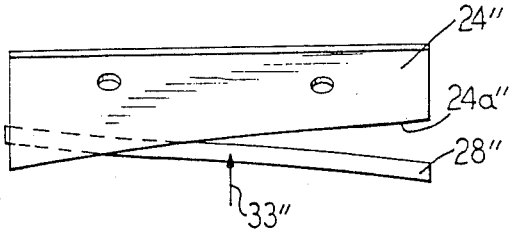
FIG. 6
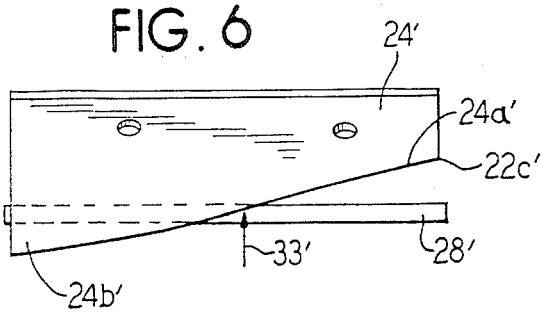

CHIP SLICER IMPROVEMENT

BACKGROUND OF THE INVENTION

This invention relates to apparatus for chipping wood chips used to make pulp which in turn is used in papermaking machines to make paper and paperboard products. More particularly, this invention relates to apparatus for receiving oversize wood chips and rechipping them into chips having acceptable (i.e. thinner) thickness, but substantially the same length and width.

In the paper industry, wood pulp is made by subjecting wood chips to a chemical process wherein the compounds and chemical systems holding the fibers together, such as lignin, to form the chip are dissolved to thereby liberate the individual wood fibers which are then diluted with water and introduced into a papermaking machine to make the paper or paperboard products. If the wood chips introduced into the refiners in which the chemical fiber liberating process takes place are not of a relatively uniform thickness, within predetermined limits, some chips might not be penetrated by the chemicals at all, or not penetrated for a time sufficient to liberate all the wood fibers. Other chips, if they are too thin, might be exposed to the fiber liberating chemicals for a time longer than necessary to merely liberate the individual fibers whereupon the fibers themselves would be deleteriously weakened, or shortened, or both. Thus, it is very important that the thickness of the chips sent into the pulping digester be uniform within specified limits determined by the kind of wood and desired pulp parameters. Since the chipping equipment operates against the external surface of the logs being chipped, it is relatively easy to control the chip length which coextends substantially with the wood grain along the surface of the generally cylindrical log.

However, the thickness of the individual wood chips is in the direction extending radially inwardly to the center of the log. In other words, the chip thickness might generally be described as extending in a direction normal to an imaginary plane tangent with the generally cylindrical surface of the log periphery. The thickness of the chips produced is therefore more difficult to control since they sometimes are gouged or broken out in chunks. The chips produced by the chipping apparatus are screened and classified. Oversize chips have heretofore been sent to one of several types of known chip slicers. For example, a so-called disk-type chip slicer operates by rotating a disk containing a plurality of blades in its face against a stationary bed knife. Gravity fed chips are discharged upwardly under the impetus of the rotating disk blades.

Other types of known chip slicers include the rigid-hammer type shredder which utilizes a punch and die type of action wherein teeth mounted on a rotating shaft rotate through slots in stationary anvils. The swing-hammer type shredder utilizes a plurality of pivotally mounted hammers which rotate and force chips through a grid-like breaker plate.

All of these prior types of chippers/shredders have a common characteristic in that their knives, blades and hammers engage the chips in a random manner which results in the chips being cut, broken and pulverized so that the smaller chips produced have undesirable shorter lengths as well as thinner thickness. A great deal of undesirably small chips and pieces are produced as well.

One apparatus and method of improving the formation of wood chips from oversize wood chips is disclosed in U.S. Pat. No. 4,235,382, issued Nov. 25, 1980. The present invention provides improvements over the concepts disclosed in said patent.

SUMMARY OF THE INVENTION

The present invention provides for improvements over the methods and devices heretofore used for chipping operation and particularly for chip slicing by reducing the size of chips. The present arrangement reduces the amount of chips which are disintegrated, shortened, crushed or otherwise reduced to unacceptable fines. In the equipment employed, improvements are achieved in a better severing operation in the cutting of the chips, and this is done with a more smooth transfer of power from the drive for the mechanism to the cutter and with less impact and jarring. The cutting is achieved by an anvil rotor having a plurality of rotor arms to rotate concentrically within a rotating substantially cylindrical segmented drum having slots therein with knives at the sides of the slots. The tips of the rotor arms are equipped with anvil blades which cooperate with the knives adjacent the slots. Both the rotor arms and drum rotate in the same direction but at different speeds. The knives and blades are situated at an angle to each other so that a slicing scissoring action is effected which attains better cutting and a reduction of the undesirable production of fines which occurs with less than acceptable cutting and tearing and disintegration of the chips as above discussed.

The oversize wood chips are introduced near the center of rotation and are transferred and oriented against the inner periphery of the drum wall by centrifugal force where the faster rotating blades on the anvil rotor arms engage them and move them to the next drum knife in the direction of rotation and with the slicing operation, the cut portion of the chip passes outwardly through the slot. The slicing of the chips is accomplished by the interaction between the knives and blades and their orientation at an angle to each other is accomplished by situating either or both at an angle to the axis of the drum.

The normal chipping process produces chips, oversize or otherwise having a length greater than their width or thickness. In accordance with the present invention, this factor is utilized by subjecting the chips to centrifugal force which acts through their center of gravity. This force causes the chip to rotate about a short edge to thereby orient the chip with its long side against the drum wall as disclosed in the aforesaid U.S. Pat. No. 4,235,282. The subsequent cutting or slicing of the chips is made in the same general plane as the length dimension so that each subsequently sliced chip has most of its wood fibers extending in the length direction. The cutting is smooth and with a scissors-like action which helps insure that the fibers liberated in the chemical pulping process will tend to be long which is the desired result. Utilizing the overall concept of the method, the orientation of the oversize chips on the drum segments results in the production of less fines because the chips are cut substantially lengthwise and with the angular orientation between the knives and blades, a careful slicing action occurs which reduces the tendency of tearing to improve the final cutting of the chip and to reduce the fines which are formed. The angular orientation between the blades and knives reduces the shock load on the drum and the anvil rotor shafts and this reduces the power input as well as improving the product.

It is accordingly an object of the present invention to produce a wood chip slicer which operates in accordance with the method that improves the cutting or slicing operation of the chip, reducing the tendency to tear and consequently reducing the amount of fines and producing and retaining better long fibers from the chips.

A still further object of the invention is to provide a chip slicing apparatus which operates smoothly and reduces the power input thereby making it possible to increase the capacity of the mechanism.

Other objects, advantages and features will become more apparent with the teaching of the principles of the invention in connection with the disclosure of the preferred embodiments thereof in the specification, claims and drawings, in which:

DESCRIPTION OF THE DRAWINGS

FIG. 3 is a fragmentary view of the chip slicer showing parts with a portion of the housing broken away to illustrate the interior;

FIG. 4 is an enlarged vertical fragmentary view taken substantially along line IV—IV of FIG. 3; and FIGS. 5 through 7 are somewhat schematic perspective views showing the relationship between blades and knives in the chip slicer for different embodiments of the invention.

DESCRIPTION OF THE PREFERRED EMBODIMENTS

Figure 1:
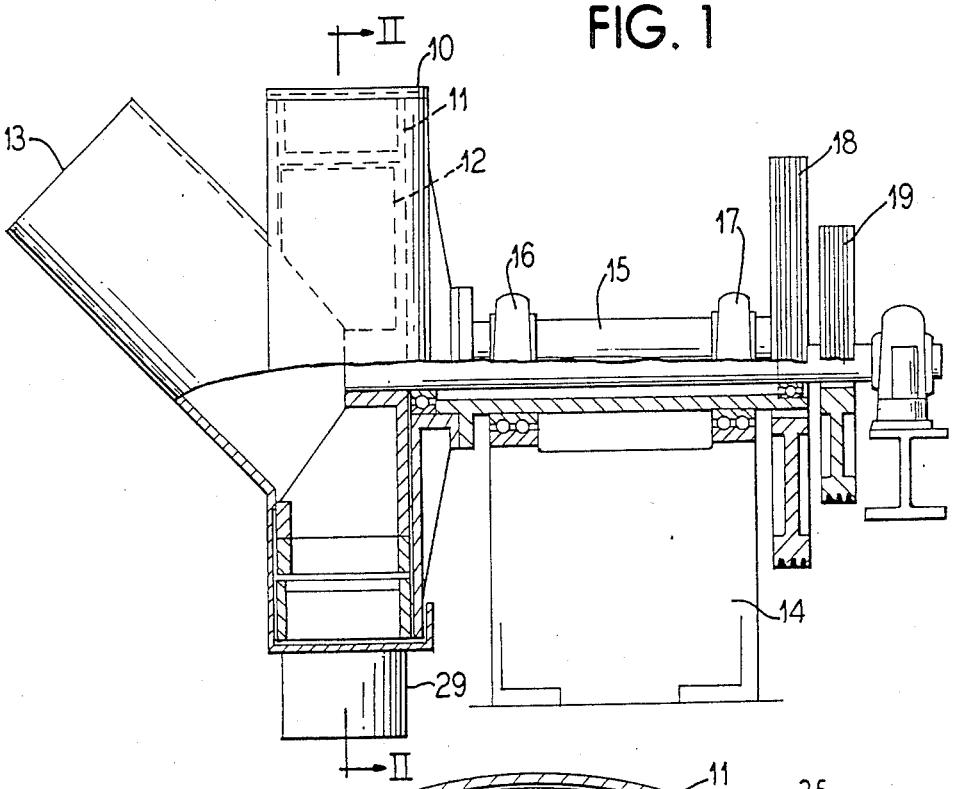
FIG. 1 is a side elevational view, with portions broken away, of a chip slicer constructed and operating in accordance with the principles of the present invention.

As illustrated in FIG. 1, a wood chip slicer is shown which may be generally referred to as a slicer and includes at the operative end on the left in FIG. 1, an annular housing 10. Within the housing is a rotatably situated cylindrical drum 11. Within the drum and coaxial therewith is an anvil rotor 12 with the drum and anvil rotor being driven in rotation and carried on coaxial shafts located generally at 15. Spaced bearings 16 and 17 support the shafts. The anvil rotor 12 is driven in rotation by suitable means such as shown by a sheave 18, and the drum is similarly driven in rotation in the same rotational direction but at a lower RPM by a suitable means such as a sheave 19. A suitable power means in the form of a motor with belts driving the sheaves or gear arrangements are provided as will be appreciated by those versed in the art.

Figure 2:
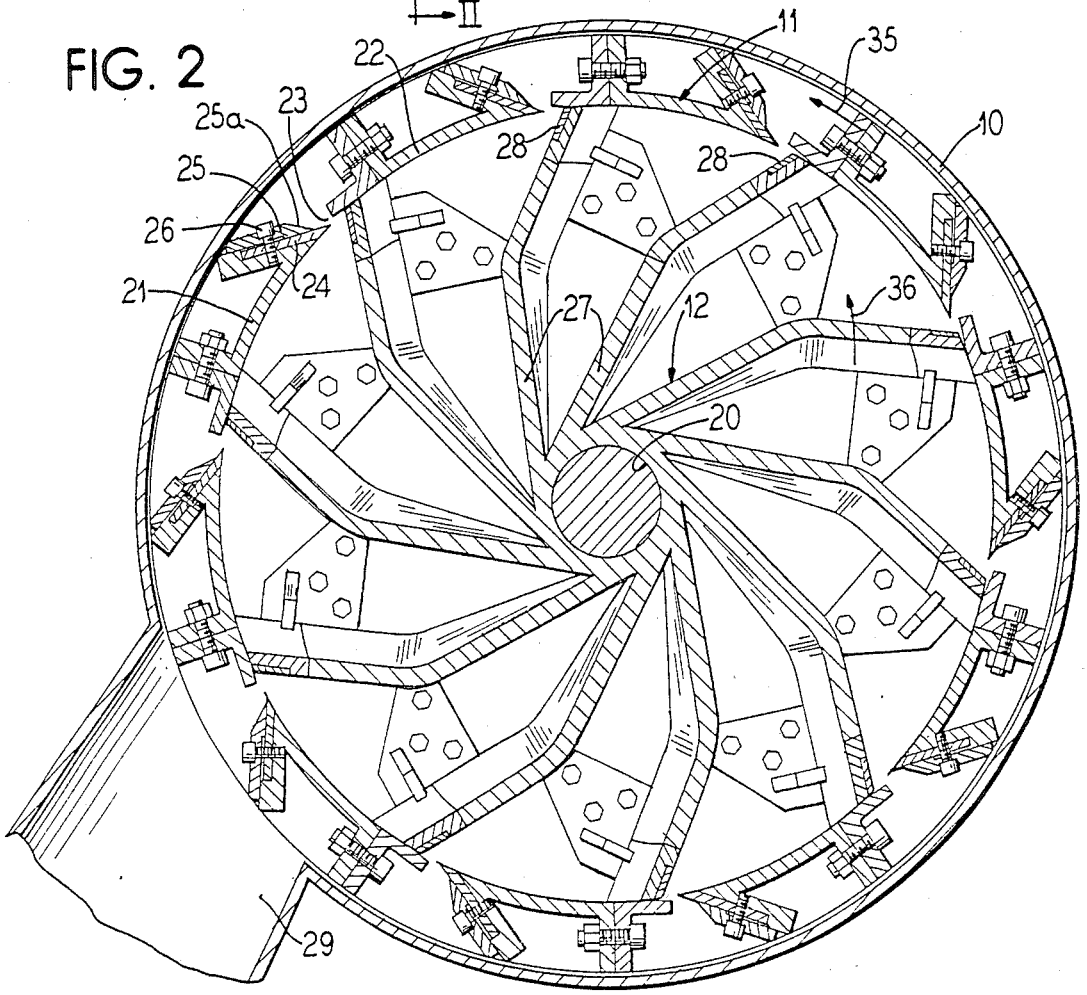
FIG. 2 is an enlarged vertical section taken substantially along line II—II of FIG. 1.

A suitable stand or support 14 is provided for mounting the unit on a floor. Wood chips to be sliced are supplied by an input chute 13 which feeds coaxial into the center of the anvil rotor at 20 as shown in FIG. 2. The discharge for the sliced finer cut chips is provided by a discharge spout 29, FIGS. 1 and 2.

Within the annular enclosing housing 10, is the drum 11 as shown in greater detail in FIG. 2. The drum is separated into a plurality of segments 11 with the segments spaced from each other so as to provide axially extending slots 23 between the segments 22. The segments otherwise have a smooth inner annular surface for receiving the chips which are thrown outwardly due to centrifugal force by the anvil rotor 12.

At the trailing end of each of the slots 23 is located a knife 24 having a cutting edge **24*a* facing the oncoming chip C as illustrated in FIG. 4. The knife is clamped in place in the drum by a clamping bar 25 held down by a capscrew 26. The clamping bar has a shoulder 25*a* facing the oncoming chip helping break it as it is cut by the cutting edge 24*a* of the knife 24**.

The size of the slot and the depth of the chip is controlled by an angle bar 30 which is mounted at the lead end of the slot, being held in place by a series of bolts 34. To adjust the size of the slot 23, the bar can be tilted by adjusting a set screw 32 which bears against the upper leg of the angled bar forcing it down toward the cutting edge of the knive **24*a* until the desired width of gap is achieved, and this will determine the depth of the chip which is cut as illustrated in FIG. 4**.

The chips are forced past the slot by the relative rotation of the anvil rotor 12 which rotates in the same direction as the drum 11 but at a faster speed. The direction of rotation of the drum is shown by the arrowed line 35 in FIG. 2, and the rotation of the anvil rotor is shown by the arrowed line 36.

The anvil rotor 12 has a hollow core 20 to admit the larger chips entering the chip slicer with openings to allow the chips to be centrifugally thrown outwardly against the inner surface of the drum 11. The anvil rotor has a plurality of radially outwardly extending support arms 27 which carry axially extending blades 28 at their outer ends. It is the blades 28 which carry the chips along the inner surface of the drum to force them past the slots and to form an anvil against which the chips are cut.

The individual chips are cut in a scissors-like slicing action with the cut progessing in an axial direction due to the relative angle between the knives 24 and the anvil blades 28. The effect of this relative angular relationship and the structure which effects this relationship may be observed in connection with FIGS. 3 and 5 through 7.

While a plurality of chips may be simultaneously cut across the width or axis of the mechanism, each chip is progessively cut by being caught between the anvil 28 and the knife 24 with the cut starting at one end of the chip and progressing therealong. Since the chips tend to be axially oriented between the knife and anvil blade, the fibers tend to extend in an axial direction and the cut progresses in the direction that the fibers extend. This gradual scissors-like cutting reduces the shock load on the machine as the anvil blade 28 pushes the chip into the slot and the thin slice is removed from the chip in the chip slicing operation. Also, the scissors-like action reduces the power required for cutting.

In the arrangement illustrated in FIGS. 3 and 5, the knives 24 and their cutting edge **24*a* extend in an axial direction parallel to the axis of the drum. The anvil blade 28 is set at an angle to the axis so that a lead edge first passes the knife edge 24*a* and the anvil progressively closes the gap against the cutting edge until the trailing end of the anvil knife 28*b* passes. The relative movement of the anvil blade past the knife is shown by the arrowed line 33 in each of FIGS. 5 through 7**.

In FIG. 6 the anvil blade **28*a* is set axially parallel to the axis of the drum and, of course, this is also parallel to the axis of the anvil rotor. In this arrangement, the cutting edge 24*a*' of the knife 24' is shaped so that it is at an angle to the axis of the drum so that the lead edge 24*b*' is passed by the anvil before the trailing edge 24*c*'. In this arrangement, the cutting edge 24*a*'** of the blade is also arranged with a slight curvature so as to enhance the scissors-like cutting action.

In the arrangement of FIG. 7, both the cutting edge 24a'' of the knife 24'' and the anvil 28' are arranged at angles to the axis of the drum. Each of the arrangements of FIGS. 5 through 7 provide a relative angle between the anvil blade and the knife. The speed of closing between the anvil blade and the knife is controlled by the relative angle therebetween.

In operation, a stream of oversize chips is fed into the chip slicer through the inlet 13. As the chips are distributed along the axis of the anvil rotor 27, they are circumferentially thrown outwardly to arrange themselves somewhat axially along the inner surface of the drum 11. Both the drum 11 and the anvil rotor 27 are rotating in the same direction, but the rotor rotates at a somewhat higher speed so that each anvil blade 27 pushes past the slots 23 in the drum. As the chips C, FIG. 4, are pushed past the slot, they are sliced by the cutting edge 24a of the knives 24. The size of the slot, controlled by the setting of the angle bar 30, will determine the depth of cut taken from the chip C. The chip is severed in a scissors-like action between the relative angled surfaces of the anvil 28 and the edge 24a of the knife. When the knife is arranged at an angle, such as illustrated in FIGS. 6 and 7, it may be desirable to also form the slot at an angle in the drum so that the entire knife is at an angle rather than manufacturing the knife unsymmetrical as illustrated in FIGS. 6 and 7. If the slot is placed at an angle, a knife of uniform width may be employed and the angle between the anvil blade and the knife will be achieved.

As the chips are sliced and small pieces are taken therefrom, they are discharged through the discharge chute 29, FIG. 2.

Thus, it will be seen that there has been provided an improved chip slicer which achieves an improved cutting with a minimum of tearing of the chips and thereby producing a smaller amount of fines and a greater amount of long fibers. The machine with its scissors-like action on the chips operates with less shock and reduces power consumption.

I claim as my invention:

1. A mechanism for slicing oversize wood chips into smaller chips, which mechanism includes an enclosing housing; a cylindrical drum adapted to be rotated about its longitudinal axis within the housing and having a wall including a plurality of segments defining a corresponding plurality of slots in the wall, with the slots extending generally longitudinally along the drum wall, the wall including a plurality of knife elements each being mounted in a wall segment adjacent a slot; means for introducing oversize chips into the drum; an anvil rotor having a plurality of arms each with a corresponding blade element mounted thereon, with the anvil rotor adapted to rotate concentrically within the drum; and means for rotating the anvil rotor and drum in the same direction at different rotational speeds, with the rotor arm speed being greater than the drum speed; whereby oversize chips are positioned and oriented against the drum wall by centrifugal force where they are engaged by the anvil rotor arm blade elements and moved along the wall to the next drum knife element where relative movement of the blade element pushing the chip past the knife element cuts a slice from the chip to pass through a slot for discharge from the mechanism; the improvement comprising:

said knife elements and said blade elements being mounted on, respectively, the wall segments and rotor arms angularly relative to each other, passing knife and blade elements thereby defining a region for cutting chips between them less than the length of either, with said region for cutting chips beginning at one end of the passing knife and blade elements and progressing along the axial extent of both to the opposite ends as the blade rotates past the knife.

2. A mechanism for slicing oversize wood chips into smaller chips constructed in accordance with claim 1:

wherein each of said knife elements is parallel to its slot.

3. A mechanism for slicing oversize wood chips into smaller chips constructed in accordance with claim 1:

wherein one of said knife and blade elements is parallel to the axis of said drum.

4. A mechanism for slicing oversize wood chips into smaller chips constructed in accordance with claim 1:

wherein said blade element is parallel to the axis of the drum.

5. A mechanism for slicing oversize wood chips into smaller chips constructed in accordance with claim 1:

wherein said knife element is parallel to the axis of the drum.

6. A mechanism for slicing oversize wood chips into smaller chips constructed in accordance with claim 1:

wherein each of said blade and knife elements are at an angle to the axis of the drum.

7. A mechanism for slicing oversize wood chips into smaller chips constructed in accordance with claim 1:

wherein one of said knife and blade elements is curved.

8. In a method for slicing oversize wood chips into smaller chips employing a cylindrical drum within a housing with the drum having a longitudinal axis and a knife element mounted adjacent a slot in the drum wall, by introducing oversize chips into the cylindrical drum, rotating the drum about its longitudinal axis to induce centrifugal force on the oversize chips to position them against the inner surface of the drum and orient them substantially with their thickness dimension extending substantially toward the longitudinal axis of rotation, rotating a blade within the drum concentrically about the longitudinal axis and in proximity with the knife, with the blade rotated in the same direction as the drum rotation but at a different speed than the drum so that the blade moves the chips along the wall to engage a drum knife to take a slice from the chips, and removing the smaller chip slices taken from the oversize chips; the improvement comprising:

passing the blade past the knife at an angle, thereby defining a limited region of slicing action which progresses from one end of the passing knife and blade to the other end thereof as the blade passes.

9. A method for slicing oversize wood chips into smaller chips utilizing a cylindrical drum having a longitudinal axis and a plurality of knives mounted in the drum wall adjacent slots in accordance with the steps of claim 8:

including positioning said blade at an angle to the longitudinal axis of the drum.

10. A method for slicing oversize wood chips into smaller chips utilizing a cylindrical drum having a longitudinal axis and a plurality of knives mounted in the drum wall adjacent slots in accordance with the steps of claim 8:

including positioning the knives at an angle to the axis of the drum.

11. A method for slicing oversize wood chips into smaller chips utilizing a cylindrical drum having a longitudinal axis and a plurality of knives mounted in the drum wall adjacent slots in accordance with the steps of claim 8:

including positioning both said knives and said blades at an angle to the longitudinal axis of the drum.

12. A method for slicing oversize wood chips into smaller chips utilizing a cylindrical drum having a longitudinal axis and a plurality of knives mounted in the drum wall adjacent slots in accordance with the steps of claim 8:

including providing a curvature in the cutting edge of at least one of said knife and blade members.

* * * * *